US011377936B2

(12) United States Patent
Sampson

(10) Patent No.: US 11,377,936 B2
(45) Date of Patent: Jul. 5, 2022

(54) CARTRIDGE SYSTEM AND METHOD FOR SETTING A TOOL

(71) Applicant: Baker Hughes Oilfield Operations LLC, Houston, TX (US)

(72) Inventor: Timothy Sampson, Tomball, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 16/991,877

(22) Filed: Aug. 12, 2020

(65) Prior Publication Data

US 2022/0049588 A1 Feb. 17, 2022

(51) Int. Cl.

| | |
|---|---|
| ***E21B 43/117*** | (2006.01) |
| ***E21B 43/1185*** | (2006.01) |
| ***E21B 43/119*** | (2006.01) |
| *E21B 47/12* | (2012.01) |

(52) U.S. Cl.

CPC ..... *E21B 43/1185* (2013.01); *E21B 43/117* (2013.01); *E21B 43/119* (2013.01); *E21B 47/12* (2013.01)

(58) Field of Classification Search

CPC .. E21B 43/117; E21B 43/1185; E21B 43/119; E21B 47/12; F42D 1/05

See application file for complete search history.

(56) References Cited

U.S. PATENT DOCUMENTS 5,396,951 A 3/1995 Ross
5,775,426 A * 7/1998 Snider ..... E21B 37/08 166/308.1
6,158,511 A * 12/2000 Wesson ..... E21B 37/08 166/308.1
8,960,288 B2 * 2/2015 Sampson ..... E21B 23/01 166/297
9,080,433 B2 7/2015 Lanclos et al.
10,273,788 B2 * 4/2019 Bradley ..... F42B 5/035
10,386,168 B1 * 8/2019 Preiss ..... E21B 43/119
10,982,941 B2 * 4/2021 Eitschberger ..... F42D 1/05
2011/0259607 A1 10/2011 Carisella
2012/0247769 A1 10/2012 Schacherer
2015/0330171 A1 11/2015 Cannon
2019/0048694 A1 2/2019 Sullivan
(Continued)

OTHER PUBLICATIONS

International Search Report and Written Opinion dated Nov. 22, 2021 in corresponding PCT Application No. PCT/US21/45690.

*Primary Examiner* — Daniel P Stephenson
(74) *Attorney, Agent, or Firm* — Hogan Lovells US LLP

(57) ABSTRACT

An assembly for perforating a downhole formation includes a perforating gun, coupled to a downhole conveyance system, the perforating gun including an explosive charge and an uphole contact. The assembly also includes a tandem, coupled to the perforating gun proximate the uphole contact, the tandem including a cartridge assembly communicatively coupled to the downhole contact and a primary igniter communicatively coupled to the cartridge assembly. The assembly further includes an intermediate sub, coupled to the tandem opposite the perforating gun, the intermediate sub receiving at least a portion of the primary igniter, the intermediate sub having a fuse and secondary igniter. The assembly also includes a setting tool coupled to the intermediate sub, the setting tool receiving a setting signal via the secondary igniter.

19 Claims, 4 Drawing Sheets

(56) References Cited

U.S. PATENT DOCUMENTS

| | | | | |
|---|---|---|---|---|
| 2019/0353013 | A1* | 11/2019 | Sokolove | E21B 43/117 |
| 2019/0376775 | A1* | 12/2019 | Preiss | C06C 5/04 |
| 2021/0164331 | A1* | 6/2021 | Sokolove | F42B 3/182 |
| 2021/0222525 | A1* | 7/2021 | Dyess | F42C 19/06 |

* cited by examiner

CARTRIDGE SYSTEM AND METHOD FOR SETTING A TOOL

BACKGROUND

1. Field of Invention

This disclosure relates in general to oil and gas tools, and in particular, to systems and methods for fracturing operations including setting tools.

2. Description of the Prior Art

In oil and gas production, hydraulic fracturing may be utilized to recover hydrocarbons from an underground formation. Hydraulic fracturing operations may include a cased wellbore that is plugged and perforated, for example using a setting tool to plug the wellbore and one or more perforating guns to explosively form holes through the casing and into the formation. Often, the perforating guns are arranged in series and may be connected by one or more subs to transmit instructions and/or explosive energy for ignition. Additionally, a setting tool may form a portion of the gun string in order to block subsequent flow into the wellbore when fracturing fluid is introduced after perforating. Presently, various ignitors are coupled through the various intermediate subs, which may be positioned at interfaces subject to fluid ingress, misalignment, and the like.

SUMMARY

Applicant recognized the limitations with existing systems herein and conceived and developed embodiments of systems and methods, according to the present disclosure, for improved setting tools.

In an embodiment, an assembly for perforating a downhole formation includes a perforating gun, coupled to a downhole conveyance system, the perforating gun including an explosive charge and an uphole contact. The assembly also includes a tandem, coupled to the perforating gun proximate the uphole contact, the tandem including a cartridge assembly communicatively coupled to the downhole contact and a primary igniter communicatively coupled to the cartridge assembly. The assembly further includes an intermediate sub, coupled to the tandem opposite the perforating gun, the intermediate sub receiving at least a portion of the primary igniter, the intermediate sub having a fuse and secondary igniter. The assembly also includes a setting tool coupled to the intermediate sub, the setting tool receiving a setting signal via the secondary igniter.

In an embodiment, a tandem sub for transmitting a setting signal includes a body, the body having coupling components at a first end and a second end. The sub also includes a channel, extending through at least a portion of the body. The sub further includes a cartridge assembly, positioned within the channel, the cartridge assembly having circuitry for transmitting electrical signals from the first end to the second end. The sub also includes a primary igniter, the primary igniter electrically coupled to the cartridge assembly via a downhole contact formed completely within the body.

In an embodiment, a method for forming a perforating gun string includes providing a perforating gun. The method also includes coupling a tandem sub to the perforating gun at a first end, the tandem sub having a cartridge assembly forming an uphole contact with the perforating gun. The method further includes coupling a setting tool to a second send of the tandem sub, opposite the perforating gun, a power charge of the setting tool being explosively coupled to the cartridge assembly.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
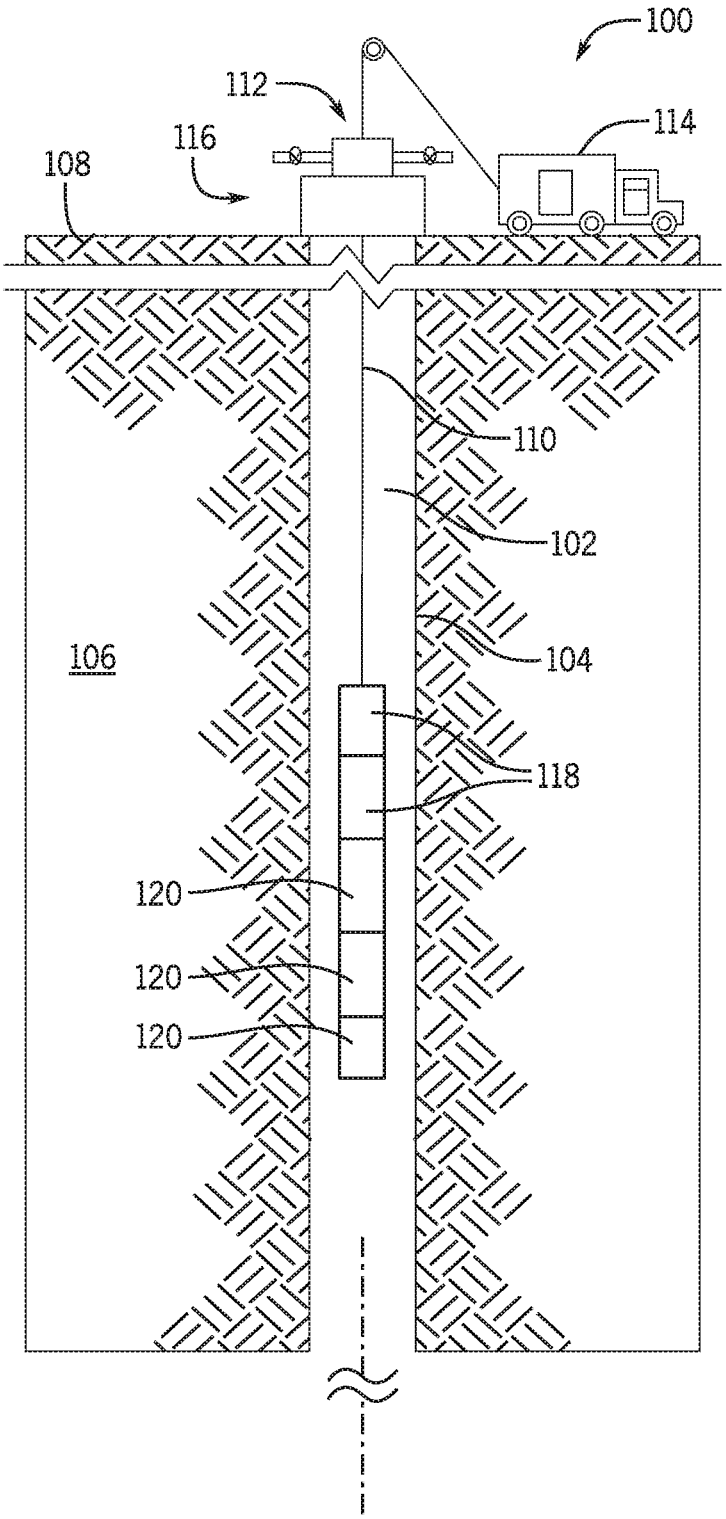
FIG. 1 is a cross-sectional side view of an embodiment of an wellbore system, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure are directed toward systems and methods that may improve the reliability of transmitting signals to setting tools used in perforating gun strings. Various embodiments include a sub or tandem that receives a cartridge assembly for transmitting instructions and/or operational energy to set setting tool. By way of example, the cartridge assembly may include a contact that is closely positioned and/or in contact with a primary igniter. Upon activation, the contact may transmit a voltage to the primary igniter, which ignites the primary igniter and transmits energy to a fuse extending through an intermediate sub.

The fuse may provide energy to a secondary igniter, which is utilized to ignite a power charge, which may set the setting tool. Embodiments of the present disclosure may provide a tandem or sub assembly that houses both the cartridge assembly and the primary igniter, among other components. By arranging the cartridge assembly in a common housing with the primary igniter, the likelihood of misalignment or damage during gun string makeup is reduced. For example, often gun strings are formed at a well site, where various components may be exposed to dirt or debris. This dirt or debris may block the contact between the cartridge assembly and the primary igniter, thereby preventing transmission of energy and setting of the tool, which may lead to undesirable additional runs to correct the error. Closely positioning the contact and the primary igniter in a common housing enables a controlled assembly in an environment with a reduced risk of contamination and also reduces assembly on site, thereby simplifying operations.

FIG. 1 is a schematic cross-sectional view of an embodiment of a wellbore system 100 including a downhole tool 102 arranged within a wellbore 104 formed in a formation 106. The downhole tool 102 is lowered from a surface location 108 via a conveyance system, such as the illustrated wireline 110. In various embodiments, the electric wireline may transmit electric signals and/or energy from the surface location 108 into the wellbore, for example to provide operational power for the tool 102 and/or to transmit data, such as data obtained from sensors arranged on the tool 102. In various embodiments, the tool 102 may be utilized to perform downhole operations, such as plug and perf fracturing operations, by way of example. It should be appreciated that embodiments exist where the downhole tool 102 is deployed with any other type of conveyance means, including coiled tubing, pipes, cable, and slickline. That is, embodiments of the present disclosure may be utilized in other scenarios.

The wellbore system 100 includes a wellhead assembly 112, shown at an opening of the wellbore 104, to provide pressure control of the wellbore 104 and allow for passage of equipment into the wellbore 104, such as the cable 110 and the tool 102. In this example, the cable 110 is a wireline being spooled from a service truck 114. The wellhead assembly 112 may include a blowout preventer (BOP) 116 (e.g., pressure control device).

In various embodiments, the downhole tool 102 is a perforating system that includes a series of perforating guns 118 coupled together in series. In this embodiment, the perforating guns may include intermediate subs 120 and also a setting tool 122 at and end of the string. In operation, an electrical signal may be transmitted down the wireline 110 to begin fracturing operations, which may include igniting one or more of the guns 118 and also initiating the setting tool 122. The setting tool 122 may include one or more expandable components that block flow to areas downhole of the setting tool 122, thereby enabling fracturing operations to commence after perforating.

Certain fracturing operations may be referred to as plug and perf, where a setting tool is coupled to the gun string to facilitate plugging the well before, during, and/or after perforating operations. The setting tool may be activated using a firing head that contains an igniter. With the introduction of addressable switches, a switch cartridge is incorporated into the gun strings to activate the setting tool. This adds length to the string, additional components, and additional opportunity for error. Switch cartridges may include an electric pin that makes contact with the igniter, and when voltage is applied the igniter is ignited and a flame output initiates the power charge, which sets the plug. Embodiments of the present disclosure may overcome problems with existing methods by incorporating the igniter into the switch cartridge. The electric pin is replaced with the igniter and becomes part of the cartridge, which is inserted prior to running. Accordingly, embodiments may increase the reliability of the tool by eliminating steps of separate igniter assembly, which may lead to missed runs when assembly is performed incorrectly.

Figure 2:
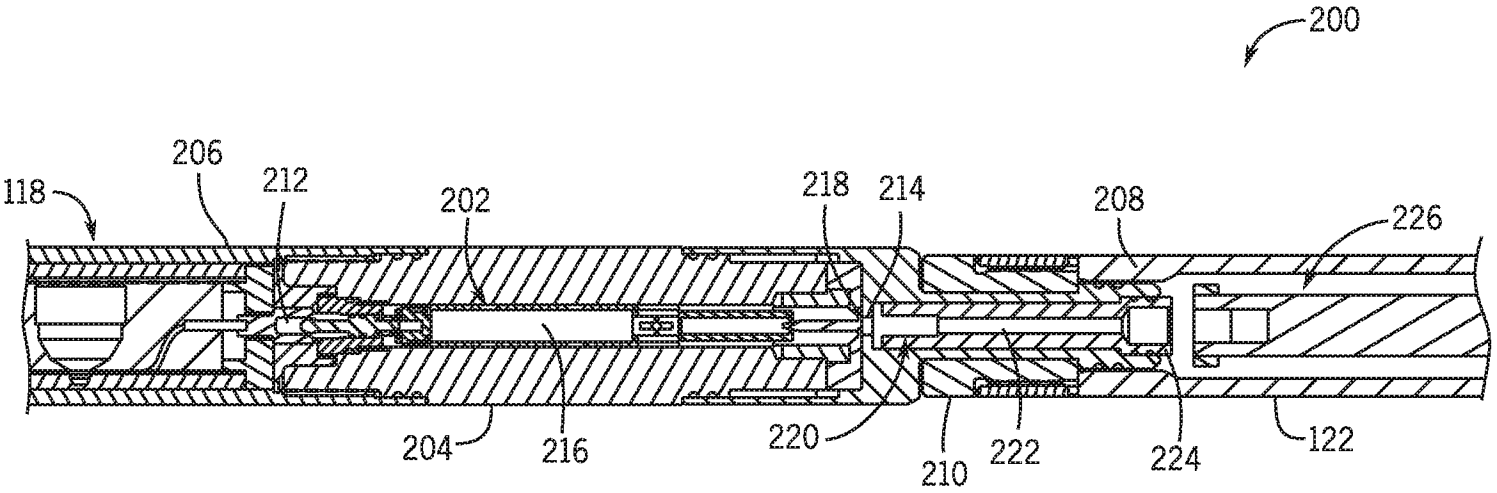
FIG. 2 is a schematic cross-sectional view of a prior art gun string.

FIG. 2 is a cross-sectional view of a prior art gun string portion 200, which may be part of a longer string that includes multiple different perforating guns 118 coupled together. In the illustrated embodiment, the perforating gun 118 may be activated by an addressable switch. In this configuration, a cartridge assembly 202 is positioned within a tandem 204 that is coupled between a body 206 of the perforating gun 118 and a body 208 of the setting tool 122. Furthermore, an intermediate sub 210 is also arranged between the tandem 204 and the body 208. As will be appreciated, in various configurations one or more of the subs may be replaced or extended.

In operation, the cartridge assembly 202 may include circuitry to transmit a signal, received from an uphole or surface source, toward the setting tool 122 to enable activation of the setting tool. The illustrated cartridge assembly 202 includes an uphole contact 212 and a downhole contact 214 to transmit information and/or energy between components. For example, the uphole contact 212 may receive an electrical signal that is transmitted along the circuity 216 (e.g., conductors, processors, timers, etc.) of the cartridge assembly 202 toward the downhole contact 214. The downhole contact 214 may include a pin 218 that extends outwardly from the cartridge assembly 202. In operation, the pin 218 may contact and engage a primary igniter 220 positioned within the intermediate sub 210 or the setting tool body 208, in certain configurations.

A voltage may be supplied that ignites the primary igniter 220, which may be a volume sensitive igniter, that is transmitted along the intermediate sub 210 via a fuse or delay 222. The fuse or delay 222 may ignite a secondary igniter 224, which actives the power charge 226 of the setting tool 122. In this manner, the command may be transmitted along the gun string to the setting tool 122. The present configuration has various drawbacks that are addressed and overcome by embodiments of the present disclosure. For example, misalignment or damage of the pin 218 with respect to the primary igniter 220 may cause a misfire event, which would lead to a second tool run in order to set the setting tool 122. These errors increase time and cost at the well site. Because the pin 218 is typically a component extending from the cartridge assembly 202, it is subject to mechanical damage (e.g., bending) as well as exposed to the environment and may be coated or otherwise interact with dust or debris. While operators may attempt to correct these issues at the site, it may be difficult with a crowded well site that is exposed to environmental conditions. Accordingly, embodiments of the present disclosure are directed to a cartridge assembly that may include the primary igniter 220 as an integrated component.

Figure 3:
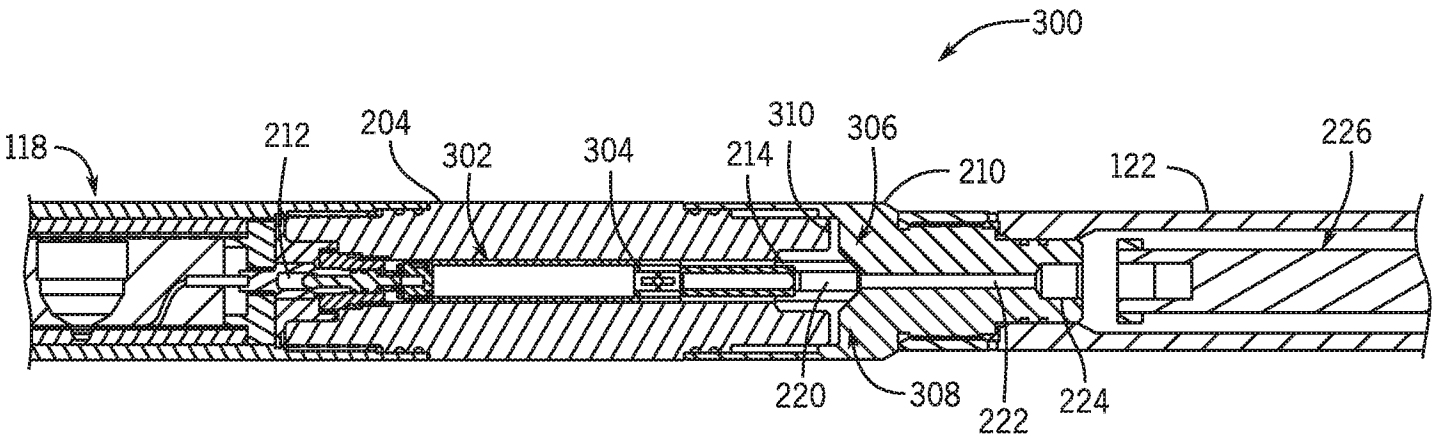
FIG. 3 is a schematic cross-sectional view of an embodiment of a gun string portion, in accordance with embodiments of the present disclosure.

FIG. 3 is a cross-sectional view of an embodiment of a gun string portion 300 utilizing embodiments of the present disclosure. The illustrated configuration includes the tandem 204 arranged between the gun 118 and the setting tool 122, and further includes the intermediate sub 210 between the tandem 204 and the setting tool 122. A cartridge assembly 302 extends through a channel 304 in the tandem 204. As noted above, the uphole contact 212 receives a signal, such as an electrical impulse, from an uphole component, which may be the gun 118, a controller, or the like, and transmits the signal to the downhole contact 214, which in this embodiment is shown within the tandem 204, rather than spanning across an interface between the tandem 204 and the intermediate sub 210. In this configuration, the primary igniter 220 is formed within the tandem 204, and as a result, problems associated with misalignment or errors between the downhole contact 214 and the primary igniter 220 may be reduced or eliminated.

When compared to the configuration of FIG. 2, the primary igniter 220 is moved out of the intermediate sub 210 and/or the setting tool 122. As a result, the connection between the downhole contact 214 and the primary igniter 220 may be formed in a controlled environment, such as an off-site production facility, which may reduce the likelihood of the above-described damage or contamination of the pin. In this configuration, the primary igniter 220 may still be volume sensitive, and as a result, is arranged to extend into a cavity 306 of the intermediate sub 210, which positions the primary igniter 220 proximate the fuse 222. Upon receipt of the signal, the command may be transmitted to the primary downhole contact 214, for example as a voltage, that sets off the primary igniter 220, is transferred along the fuse 222, sets off the secondary igniter 224, and then activates the power charge 226. In this manner, the setting tool 122 may be set.

In the illustrated embodiment, the primary igniter 220 is arranged at a downhole end 308 and extends beyond a tandem downhole face 310. Accordingly, when the intermediate sub 210 is coupled to the downhole end 308, for example via threads, the primary igniter 220 is positioned within the cavity 306. As will be appreciated, various components, such as a primary igniter length, cavity depth, and the like may be particularly selected to facilitate alignment and coupling between the primary igniter 220 and the fuse 222.

Embodiments of the present disclosure may enable the use of fewer parts and simplified assembly at the well site. For example, operators may prepare the gun string and then install the cartridge assembly 302, with the primary igniter 220, into the channel 304 for use. Because sensitive components, such as the downhole contact 214, are not exposed during this operation, the likelihood of damage or error may be decreased. Furthermore, using the cartridge assembly 302 may enable use with existing systems, for example, by substituting an older cartridge that does not include the primary igniter 220. As noted above, the illustrated cartridge assembly 302 eliminates operator assembly of the igniter because the igniter is preassembled in a controller environment and prepared for operation.

Figure 4:
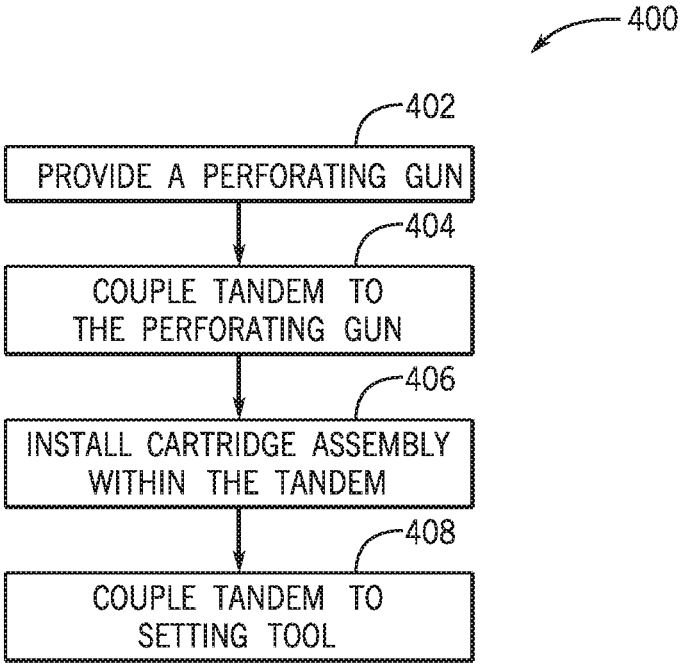
FIG. 4 is a flow chart of an embodiment of a method for assembling a gun string portion, in accordance with embodiments of the present disclosure.

FIG. 4 is a flow chart of an embodiment of a method 400 for preparing a setting tool. It should be appreciated that this method, or any method described herein, may be performed in a different order or in parallel. Moreover, there may be more or fewer steps. In this example, a perforating gun is provided 402. The perforating gun may include a coupling at a lower end, which enables attachment of a tandem to the perforating gun 404. In various embodiments, the tandem includes a channel for receiving a cartridge assembly 406. The cartridge assembly, as described above, may include a primary igniter, as opposed to other cartridge assemblies that include a contact pin and are utilized to activate primary igniters that are assembled and mounted separately. The tandem is then coupled to a setting tool 408. In certain embodiments, the setting tool may include a fuse or secondary igniter. However, in other embodiments, an intermediate sub may be positioned between the tandem and the setting tool. In this manner, a setting tool is positioned for installation in a wellbore, where the setting tool may be activated by use of the cartridge assembly.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. An assembly for perforating a downhole formation, comprising:

a perforating gun, coupled to a downhole conveyance system, the perforating gun including an explosive charge and an uphole contact;

a tandem, coupled to the perforating gun proximate the uphole contact, the tandem including a cartridge assembly communicatively coupled to a downhole contact and a primary igniter communicatively coupled to the cartridge assembly;

an intermediate sub, coupled to the tandem opposite the perforating gun, the intermediate sub receiving at least a portion of the primary igniter, the intermediate sub having a fuse and secondary igniter; and a setting tool coupled to the intermediate sub, the setting tool receiving a setting signal via the secondary igniter.

2. The assembly of claim 1, further comprising:

a power charge forming at least a portion of the setting tool, the power charge receiving explosive energy from the secondary igniter to initiate a setting operation of the setting tool.

3. The assembly of claim 1, further comprising:

a downhole contact between the cartridge assembly and the primary igniter, the downhole contact housed within a body of the tandem, the downhole contact transmitting a signal to ignite the primary igniter.

4. The assembly of claim 3, wherein the downhole contact is formed entirely within the body of the tandem.

5. The assembly of claim 1, wherein the cartridge assembly is removably positioned within a channel formed in the tandem.

6. The assembly of claim 1, wherein the primary igniter extends into a cavity formed in the intermediate sub to position the primary igniter proximate the fuse.

7. The assembly of claim 6, wherein the primary igniter is volume sensitive.

8. A tandem sub for transmitting a setting signal, comprising:

a body, the body having coupling components at a first end and a second end;

a channel, extending through at least a portion of the body;

a cartridge assembly, positioned within the channel, the cartridge assembly having circuitry for transmitting electrical signals from the first end to the second end; and a primary igniter, the primary igniter electrically coupled to the cartridge assembly via a downhole contact formed completely within the body.

9. The tandem sub of claim 8, further comprising:

an uphole contact proximate the first end, the uphole contact receiving a signal from a gun coupled to the body at the first end.

10. The tandem sub of claim 8, wherein at least a portion of the primary igniter extends axially beyond a downhole face of the tandem sub.

11. The tandem sub of claim 10, wherein the primary igniter extends axially beyond the downhole face to abut a fuse arranged within a proximate intermediate sub coupled at the second end.

12. The tandem sub of claim 8, wherein the primary igniter is volume sensitive.

13. The tandem sub of claim 8, wherein the cartridge assembly is removably positioned within the channel.

14. The tandem sub of claim 8, wherein the cartridge assembly, upon receipt of a signal, provides a voltage to the primary igniter to ignite the primary igniter.

15. The tandem sub of claim 14, wherein the signal is a non-explosive signal.

16. The tandem sub of claim 8, wherein the primary igniter is installed within the body prior to delivery to a well site.

17. A method for forming a perforating gun string, comprising:

providing a perforating gun;

positioning the cartridge assembly within a channel extending through a tandem sub; and positioning a primary igniter proximate the cartridge assembly, the primary igniter being within a body of the tandem sub to confirm a downhole contact between the primary igniter and the cartridge assembly within the body;

coupling the tandem sub to the perforating gun at a first end, the tandem sub having a cartridge assembly forming an uphole contact with the perforating gun; and coupling a setting tool to a second end of the tandem sub, opposite the perforating gun, a power charge of the setting tool being explosively coupled to the cartridge assembly.

18. The method of claim 17, wherein both the cartridge assembly and the primary igniter are positioned within the tandem sub at a location remote from a well site.

19. The method of claim 17, further comprising:

coupling an intermediate sub between the tandem sub and the setting tool, the intermediate sub including ballistic components to transfer ballistic energy from the tandem sub to the setting tool.

* * * * *